United States Patent [19]

Connery et al.

[11] Patent Number: 4,995,764

[45] Date of Patent: Feb. 26, 1991

[54] TECHNIQUE FOR STABILIZING BUILDING FOUNDATIONS

[76] Inventors: Daniel P. Connery, 337 Louise Dr., Corpus Christi, Tex. 78404; D. Dexter Bacon, 9649 Paula, Corpus Christi, Tex. 78410; Stacy K. Blair, 3802 Caravelle #514, Corpus Christi, Tex. 78415

[21] Appl. No.: 339,596

[22] Filed: Apr. 13, 1989

[51] Int. Cl.[5] ..... E02B 11/00; E02D 27/00

[52] U.S. Cl. ..... 405/229; 52/169.5; 405/258; 405/303; 405/36

[58] Field of Search ..... 405/36, 37, 50, 229; 52/1, 167, 169.1, 169.5

[56] References Cited

U.S. PATENT DOCUMENTS

| | | | |
|---|---|---|---|
| 2,219,710 | 10/1940 | Litz et al. | 405/229 |
| 3,425,175 | 2/1969 | Gerde | 52/169.5 |
| 4,191,496 | 3/1980 | Becker | 405/229 |
| 4,266,379 | 5/1981 | Aguilar | 52/167 X |
| 4,273,475 | 6/1981 | Fuller | 405/229 |
| 4,534,143 | 8/1985 | Goines et al. | 52/169.1 X |
| 4,799,339 | 1/1989 | Kobori et al. | 52/1 |
| 4,878,781 | 11/1989 | Gregory et al. | 405/36 X |
| 4,879,852 | 11/1989 | Tripp | 405/258 X |

FOREIGN PATENT DOCUMENTS

| | | | |
|---|---|---|---|
| 0155708 | 6/1982 | German Democratic Rep. | 405/284 |
| 0642438 | 1/1979 | U.S.S.R. | 405/229 |

*Primary Examiner*—Dennis L. Taylor
*Attorney, Agent, or Firm*—G. Turner Moller

[57] ABSTRACT

A foundation watering system includes a ground motion sensor which detects relative movement between a building and a stable soil zone beneath the building. The ground motion sensor includes a hole dug in the earth to a depth below a zone of shrinking and swelling a a rigid element embedded in the stable soil zone and extending upwardly to cooperate with a mechanism on the building. When the sensor detects significant downward movement of the periphery of the building, a valve is actuated to deliver water to the shrinking and swelling zone.

15 Claims, 1 Drawing Sheet

FIG. 1
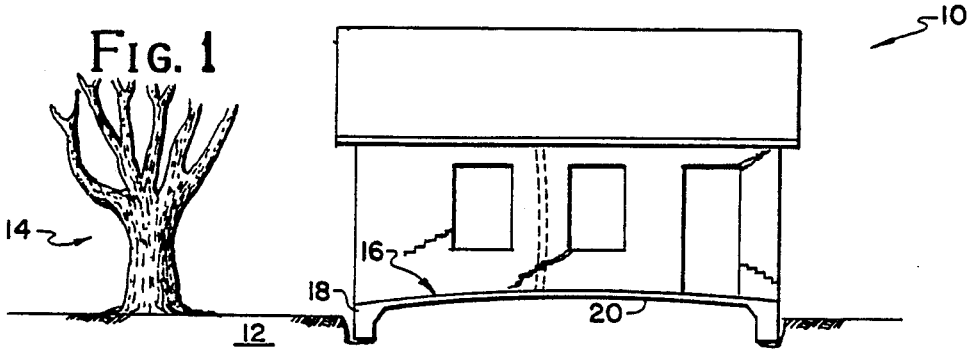
FIG. 2
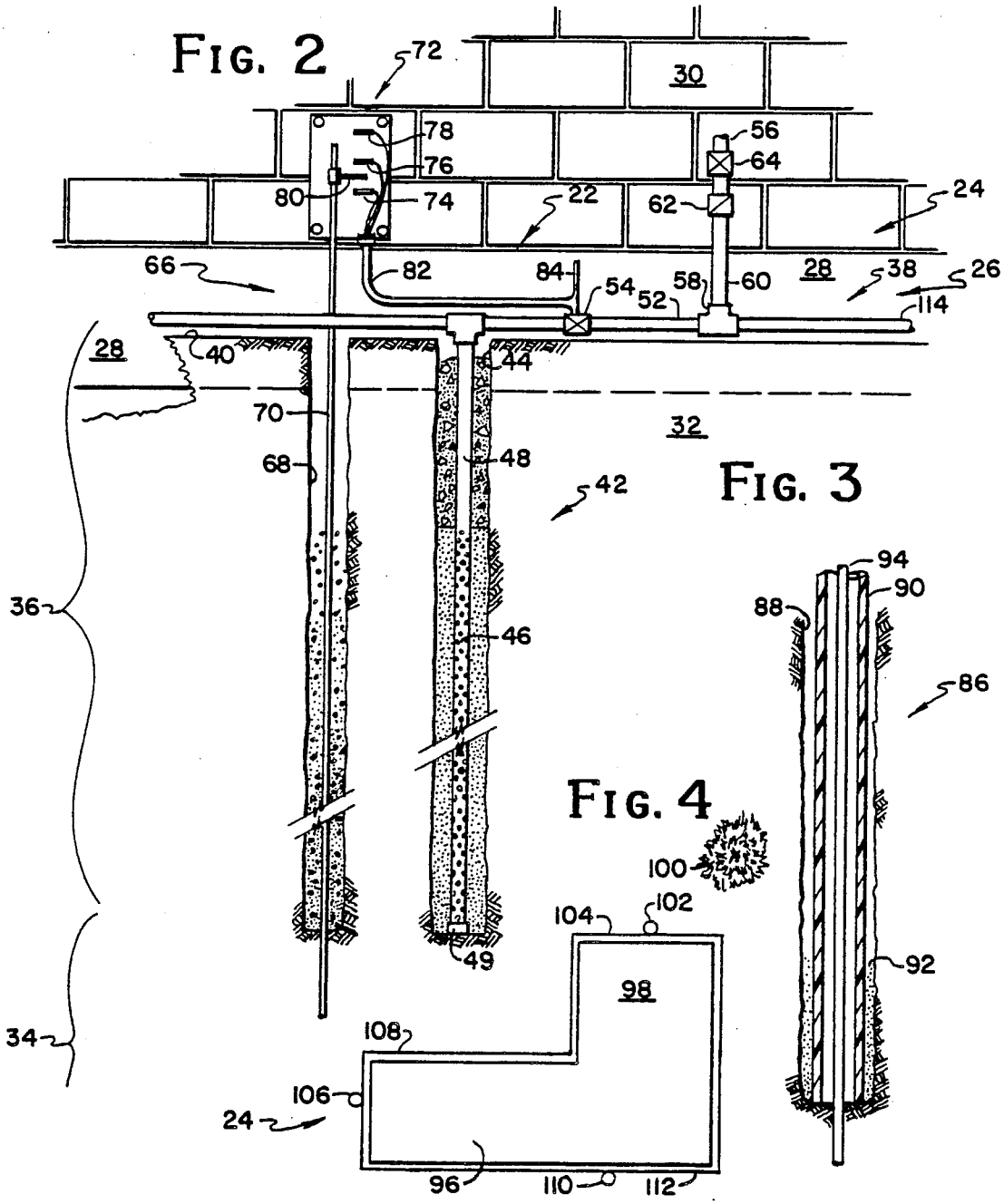
FIG. 3
FIG. 4

TECHNIQUE FOR STABILIZING BUILDING FOUNDATIONS

This invention relates to a technique for stabilizing building foundations where the underlying soil is prone to expand and contract in response to changes in water saturation.

Clay based soils shrink and swell with changes in soil moisture content. The volumetric change experienced by a soil depends primarily on the mineral type of the clays. Soils containing substantial quantities of montmorillonite, bentonite or illite can swell and shrink enough to cause substantial foundation problems for almost any type construction.

A slab-on-grade foundation is damaged most frequently during droughts because the soil shrinks significantly directly under the exterior foundation beam while the soil volume does not change much in the middle of the foundation. This shrinkage on the perimeter of the foundation leaves the foundation unsupported to some extent on its periphery. The foundation accordingly deflects downwardly along the outer edge and places the outer edges of the foundation in tension. This causes cracks in the foundation and leads to serious interior and exterior wall cracking and door shifting.

A prominent factor in the magnitude of foundation damage is the presence of trees near the foundation. Tree roots extract additional water from the soil which increases the depth of the moisture change zone and the amount of soil shrinkage in the vicinity of the tree. Some types of trees such as mesquite and willow cause more damage than other species because of their more extensive and efficient root systems.

The older type concrete slab foundation comprises rebar reinforced concrete. This type foundation is being supplanted, to a large extent, by post tensioned slabs where the reinforcing elements are tensioned after the concrete has set up. The older type foundation appears to be more capable of withstanding stresses induced by alternate shrinking and swelling of clay type soils. Observation suggests that the newer construction is more engineered, has less material and less safety factor than the older type foundation.

There are presently several foundation repair techniques. If serious cracking already exists, drilled concrete piers are placed under the exterior grade beam in the areas affected by foundation cracking and/or severe floor movement. The piers are spaced eight to twelve feet apart and extend below the shrink-swell zone, usually ten to twelve feet. After the piers have been poured and set, the floor is leveled to near its original position by the use of hydraulic jacks and shims. If the foundation has deflected but not yet failed, piers are placed to stabilize the area from further downward movement which prevents cracking. In these situations, exterior wall loads during droughts are transferred to the piers and the wall is prevented from deflecting downwardly because the building load is transferred to a stable soil zone below the zone of shrinkage and swelling.

Another broad technique for stabilizing foundations is to attack the underlying cause, i.e. shrinkage of clay type soils because of alternate wetting and drying. In these techniques, the soil around the foundation is watered to maintain a more-or-less desired moisture content to prevent the shrinking and swelling that is the cause of the problem.

The most rudimentary of these techniques is the homeowner who waters the surface near the foundation in times of drought. In some areas, this is not effective because only the top few feet of the soil actually show any substantial moisture increase. What happens is that the upper expansive clay swells and prevents water from percolating into the underlying clay which continues to dry out from water loss to plant roots. Thus, during prolonged dry periods, the soil immediately below the surface continues to shrink and the problem persists.

More sophisticated systems include a ditch dug around the perimeter of the foundation and a perforated pipe in the ditch connected to a water line. The ditch is preferably deep enough to avoid the problem of merely wetting the surface. There are a variety of techniques for turning the water on and off. An early technique was simply to water the ground surrounding the foundation in response to a clock, e.g. every week or every month the water was automatically turned on regardless of whether a drought was occurring or not. This technique has its own problems because too much water can also create or exaggerate foundation problems. A more sophisticated system used by Foundation Watering Company of Houston, Tex. incorporates moisture sensors turning on the water in response to a lack of moisture content in the soil. Another more sophisticated system is found in U.S. Pat. 4,534,143 where a valve is turned on and off in response to static water pressure in the soil. It is this type device to which this invention most nearly relates.

Other disclosures of interest are found in U.S. Pat. Nos. 3,425,175 and 4,576,511.

This invention comprises a foundation watering system for controlling the shrinking of clay based soils and thereby minimizing ground swelling and foundation damage. A suitable water distribution installation typically includes a perimeter ditch dug around the foundation and a series of wells in the ditch spaced 5–15′ apart. The wells preferably extend downwardly through the zone of shrinking and swelling, typically 5–15′. A water conduit is laid in the ditch and connects to perforated pipe in the wells. The water conduit is connected to a water line through an on-off valve and a pressure reducing valve so water is delivered to the soil at a very low pressure. A ground movement sensor or foundation movement sensor is provided to turn the valve on in response to significant soil shrinkage and to turn the valve off after sufficient water has been added to the soil to expand the clay based soil to a near original condition. The ground movement sensor includes a rigid element installed in a hole extending to stable soil, i.e. soil which does not expand or contract. This occurs at a depth where the water content of the soil does not change appreciably from a wet year to a dry year and varies from area to area. Thus, the hole may be of any suitable depth but depths of five to fifteen feet will accommodate most situations. Also in the hole is means to prevent the soil from closing on and sticking to the rigid element. Thus, the hole may be filled with granular vermiculite or the hole may be cased with plastic or metal pipe. The upper end of the rigid element extends to a location adjacent the perimeter of the foundation and a sensor cooperates between the upper element end and the foundation to sense movement between the foundation and the rigid element. When the ground shrinks and the foundation deflects downwardly sufficiently, the sensor turns on the valve to deliver water to the soil adjacent the foundation. As the clay bearing soil adsorbs the water, it expands to move the foundation to a near normal position where the foundation is not significantly flexed. The sensor detects movement to such a position and shuts off the valve leading to the water distribution system.

It is accordingly an object of this invention to provide an improved foundation water system incorporating a ground movement or foundation movement sensor.

Another object of this invention is to provide a foundation watering system in which water is delivered to clay bearing soil adjacent a foundation directly in response to movement of the foundation.

These and other objects and advantages of this invention will become apparent as this description proceeds, reference being made to the accompanying drawings and appended claims.

IN THE DRAWINGS

FIG. 1 is a stylized cross-sectional view of a building illustrating a classic foundation problem resulting from soil shrinkage;

FIG. 2 is an enlarged cross-sectional view of an installation of this invention;

FIG. 3 is a partial cross-sectional view of another embodiment of this invention; and FIG. 4 is a schematic plan view of a building equipped with a system of this invention.

Referring to FIG. 1, there is illustrated a building 10 in an area of clay soil 12 adjacent a tree 14. The building 10 includes a foundation 16 in which the perimeter 18 is sagging or deflecting downward because of shrinkage of the soil 12 due to loss of water through normal evaporation or through the roots of the tree 14. The central part 20 of the foundation 16 does not subside much because there is relatively less water loss adjacent the center of the foundation 16. This type soil movement often results in damage to the foundation 16 and to the building 10.

To overcome this problem, the foundation watering system 22 of this invention is provided. As shown in FIG. 2, a building 24 comprises a concrete slab foundation 26 including a perimeter beam 28 supporting a perimeter concrete block wall 30. The building 24 is located on a clay type soil 32 having a stable zone 34 underlying a shrinking and swelling zone 36.

A water distribution system 38 is provided to deliver water to the shrinking and swelling soil zone 36 as is needed, depending on the condition of the foundation 26. A ditch 40 is dug around the perimeter of the building 10 to any suitable depth. In FIG. 2, the ditch 40 is not quite to the bottom of the perimeter beam 28. A series of vertical wells 42 are provided by digging a series of holes 44 downwardly, preferably substantially through the shrinking and swelling soil zone 36 at suitable intervals along the ditch 40. Although there may be some variation from area to area, the wells 42 are typically 5–15' apart. A perforated pipe 46 is placed in the bottom of the hole 44 having an end cap 49 thereon. An unperforated vertical pipe 48 connects to the perforate pipe 46 and extends upwardly into the ditch 40. The pipes 46, 48 accordingly water the bottom of the shrinking and swelling soil zone 36 as opposed to merely the top. The upper part of the zone 36, in the vicinity of the foundation 26, experiences normal wetting and drying as occurs throughout the year but will not experience extreme drying which occurs during a drought.

The unperforated pipe 48 connects at a tee 50 to a water line 52 in the ditch 40. An on-off solenoid operated valve 54 controls water flow in the line 52 which is connected to a hose bib or city water supply 56 through a tee 58, riser 60, pressure regulator 62 and manual shut off valve 64. The pressure regulator 62 reduces pressure in the line 52, and thus in the pipes 46, 48 to a rather low value, usually 1–5 psig. This allows water to seep slowly through the wells 42 into the shrinking and swelling zone 36 rather than run so fast that wash outs may occur. Those skilled in the art will recognize the building 24 and water distribution system 26 as being typical of good practice in a modern foundation watering system.

The difficulty of foundation watering systems is knowing when to turn the water on and when to turn it off. In accordance with this invention, a ground motion or foundation movement sensor 66 detects when the building 24 and/or foundation 26 deflects downwardly and turns the valve 54 on to water the shrinking and swelling zone 36 and rehydrate the shrunken or dehydrated clay based soil. When enough water has been added to the zone 36 to swell the clays back to a near normal condition, the sensor 66 detects movement of the foundation 26 and/or building 24 to turn off the water. The sensor 66 thus actuates the water distribution system 26 in response to the actual cause of foundation and/or building damage, i.e. movement of the foundation, rather than some more-or-less inferential measurement such as time or soil moisture.

Very sophisticated ground motion sensors are known and used in, for example, earthquake research. Fortunately, less sophisticated and less expensive techniques are quite adequate for detecting the amount of motion that is damaging to foundations and building because almost any concrete slab foundation is designed and built to deflect an inch or so without failing or starting to fail.

Thus, the ground motion sensor 66 preferably comprises a hole 68 dug in the ditch 40 or outside the ditch 40 at a location adjacent the foundation beam 28. The hole 68 extends through the shrinking and swelling zone 36 into the stable soil zone 34, preferably well into the zone 34. The depth of moisture change in soil varies from area to area, so the holes 68 may vary from place to place. Typically, however, the hole 68 is in the range of 5–15'. A rigid element 70, in the form of a rod, channel, angle iron, pipe or the like is placed in the hole and driven, by sledge hammer, impact device or the like, into the stable soil at the bottom of the hole 68. Thus, the element 70 acts as a vertically stable benchmark against which movement of the building 24 can be measured. The element 70 extends out of the hole 68 to a location adjacent the building 24 to cooperate with a switch mechanism 72. The switch mechanism 72 may be of any suitable type and preferably includes a series of microswitches 74, 76, 78 which are tripped by an abutment 80 carried on the element 70. The switch 74, corresponding to a normal position of the foundation 26, turns the valve 54 off and thus stops water flow in the system 38. The switch 76, corresponding to a partially depressed position of the foundation 26, turns the valve 54 partially on and allows water to trickle through the system 38. The switch 78, corresponding to a substantially depressed position of the foundation 26, opens the valve 54 completely and allows as much water to pass through the system 38 as is allowed by the pressure differential created by the regulator 62. The switches 74, 76, 78 are connected to the solenoid operated valve 54 and to a source of electrical power by suitable wires extending through conduits 82, 84.

One of the problems with the sensor 66 is that there is some danger of the hole 68 closing on the rigid element 70 so the rigid element 70 is pulled out of the stable zone 34 and thereafter move with the shrinking and swelling zone 36 thereby defeating the sensor 66. A simple technique for avoiding this problem is to fill the hole 68 with some material which prevents sticking. Such a material may be thought of as a lubricant even though the material might not normally be considered lubricious. One such material is expanded vermiculite which allows movement of the soil in the zone 36 relative to the rigid element 70 without sticking.

Operation of the system of this invention should now be apparent. When the soil in the vicinity of the building 24 begins to dry out due to drought or water loss to plants, the soil zone 36 adjacent the perimeter of the foundation 26 shrinks and the beam 28 begins to move downwardly in response to the load of the wall 30. When sufficient movement occurs that the abutment 80 trips the microswitch 76, water begins trickling through the system 38 to water the zone 36 and begin rehydrating the clay. If the amount of water is insufficient to reverse dehydration of the clay, downward movement of the beam 28 continues until the abutment 80 trips the microswitch 78 to fully open the solenoid valve 54. Sufficient water is then added to stop shrinking of the zone 36 so the foundation begins to move toward its normal position. As the abutment 80 moves past the switch 76, water flow is slowed down. When the zone 36 has returned to normal, the foundation 26 will have moved to a position where the abutment 80 actuates the switch 74 and shuts the valve 54 off.

Another embodiment 86 of the motion sensor of this invention is illustrated in FIG. 3 where a hole 88 has been dug through the shrinking and swelling zone into the stable soil zone. A pipe section 90 is placed in the hole 88 and extends above ground level. Sand or fill 92 is placed in the annulus between the pipe 90 and the hole 88. An elongate rigid element 94 is driven into the stable soil zone. The inside of the pipe 90 may be left empty or filled with expanded vermiculite.

It might be thought that a single sensor 66 would be adequate to control watering of a foundation because when extreme drying occurs, it should occur every where, and its effects seen every where, in the immediate vicinity of the building 24. This is not quite true because of the presence of trees in a particular site and the geometry of the building 24. As shown in FIG. 4, the building 24 is illustrated as having a rectangular section 96 and an ell type extension 98 near a tree 100. Foundation damage in the ell 98 is particularly common and a sensor 102 is preferably located near the end of the ell 98. The sensor 66 accordingly controls water distribution in the conduit section 104 leading to a series of wells (not shown). A second sensor 106 may be provided to control water flow in a conduit section 108 and a third sensor 110 may be provided to control water flow in a conduit section 112.

Thus, the water distribution system of FIG. 2 may provided a second water conduit 114 connected to the tee 58 and having a solenoid valve (not shown) therein for delivering water to another part of the foundation 26.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

We claim:

1. A foundation watering system comprising a building in an area having a shrinking and swelling soil zone and having a foundation supported on the shrinking and swelling soil zone;

means for applying water to the shrinking and swelling soil zone; and means for detecting movement of the foundation for controlling the water applying means for adding water to the shrinking and swelling soil zone.

2. The foundation watering system of claim 1 wherein the building is in an area having a stable soil zone underlying the shrinking and swelling zone and wherein the foundation movement detecting means comprises a rigid element having a first end in the stable soil zone and a second end adjacent the building and means on the building cooperating with the second end for detecting movement of the building.

3. The foundation watering system of claim 2 wherein the foundation movement detecting means includes a lubricant between the rigid element and the shrinking and swelling zone.

4. The foundation watering system of claim 3 wherein the lubricant is expanded vermiculite.

5. The foundation watering system of claim 3 wherein the lubricant is air.

6. The foundation watering system of claim 2 further comprising a pipe extending to the stable soil zone, the rigid element being inside the pipe.

7. A foundation watering system comprising a building in an area of clay bearing soil having a stable soil zone underlying a shrinking and swelling soil zone and having a foundation supported on the shrinking and swelling soil zone;

a water distribution system for applying water to the shrinking and swelling soil zone including a conduit for connection to a source of water and a valve; and means for detecting movement of the foundation and for controlling the valve including a foundation movement sensor comprising a rigid element, at a location adjacent the building, extending into the stable soil zone and a sensor on the building cooperating with the rigid element for opening and closing the valve in response to movement between the rigid element and the sensor.

8. A method of watering a building foundation including digging a hole in the earth adjacent the building through a soil zone of shrinking and swelling to a stable soil zone;

placing a rigid element in the hole and embedding the rigid element in the stable zone;

lubricating the element relative to the hole allowing the element to move relative to the hole;

detecting relative movement between the rigid element and the building; and initiating water injection into the shrinking and swelling zone adjacent the building in response to detected relative movement between the rigid element and the building.

9. A system for watering adjacent a building having a foundation, comprising a water distribution system for applying water to soil adjacent the building including a conduit having water outlet openings therein and an inlet for connection to a source of pressurized water, an on-off valve and a pressure reducing valve for reducing the pressure of water delivered to the conduit; and means for detecting movement of the foundation including a foundation movement detector including a rigid element of sufficient length to extend from the foundation to an area of stable soil, means preventing sticking of the rigid element to the soil, and a sensor operative between the rigid element and the building for detecting movement of the building relative to the rigid element for manipulating the on-off valve.

10. The system of claim 9 wherein the sticking preventing means comprises granules around the rigid element.

11. The system of claim 9 wherein the sticking preventing means comprises a conduit around the rigid element.

12. A foundation watering system comprising a building in an area having a shrinking and swelling soil zone and having a foundation supported on the shrinking and swelling soil zones;

means for applying water to the shrinking and swelling soil zone; and means for detecting movement of the shrinking and swelling soil zone for controlling the water applying means for adding water to the shrinking and swelling soil zone.

13. The foundation watering system of claim 12 wherein the building is in an area having a stable soil zone underlying the shrinking and swelling zone and wherein the soil zone movement detecting means comprises a rigid element having a first end in the stable soil zone and a second end adjacent the building and means on the building cooperating with the second end for detecting movement of the building.

14. The foundation watering system of claim 13 wherein the soil zone movement detecting means includes a lubricant between the rigid element and the shrinking and swelling zone.

15. The foundation watering system of claim 14 wherein the lubricant is expanded vermiculite.

* * * * *